United States Patent [19]

Engel

[11] 4,431,155

[45] Feb. 14, 1984

[54] COVER SLEEVE FOR SHELVING BRACKETS OF THE BLADE TYPE

[76] Inventor: Robert Engel, 265 Edinburg Rd., Mercerville, N.J. 08619

[21] Appl. No.: 378,661

[22] Filed: Jun. 17, 1982

[51] Int. Cl.[3] ..... A47G 29/02

[52] U.S. Cl. ..... 248/243; 108/108

[58] Field of Search ..... 248/243, 246, 235, 239, 248/241, 245, 247, 250; 108/108; 211/193

[56] References Cited

U.S. PATENT DOCUMENTS

| | | | |
|---|---|---|---|
| 3,057,483 | 10/1962 | Derman | 248/250 X |
| 3,525,493 | 8/1970 | Chrietzberg et al. | 248/224.2 X |
| 3,707,273 | 12/1972 | Bertz | 248/235 |
| 3,917,421 | 11/1975 | Carmien | 403/268 X |
| 4,117,784 | 10/1978 | Piretti | 403/253 X |
| 4,198,913 | 4/1980 | Haworth | 108/108 |
| 4,246,710 | 1/1981 | Mixer | 248/DIG. 9 X |

FOREIGN PATENT DOCUMENTS

| | | | |
|---|---|---|---|
| 1466501 | 12/1966 | France | 248/250 |
| 62577 | 6/1940 | Norway | 403/243 |
| 1280059 | 7/1972 | United Kingdom | 248/235 |

*Primary Examiner*—J. Franklin Foss

*Attorney, Agent, or Firm*—Frederick A. Zoda; John J. Kane

[57] ABSTRACT

A sleeve-like covering is provided for a shelving bracket, in particular a bracket that is usually formed from sheet metal as an elongated, blade-like arm having mounting hooks engageable in selected slots of a vertical standard. The covering is formed with an upwardly opening kerf or groove receiving an otherwise basically conventional shelf bracket of the type described, and has means for tightly gripping the bracket responsive to engagement of the blade-like bracket arm in the groove. When so applied, the covering completely conceals the metallic blade to enhance the appearance of a shelving system. The covering may be formed of wood adapted to match or harmoniously blend or contrast with the shelving material. Or, the bracket cover may in some instances be of a molded plastic, again selected to complement the shelves supported thereon.

3 Claims, 7 Drawing Figures

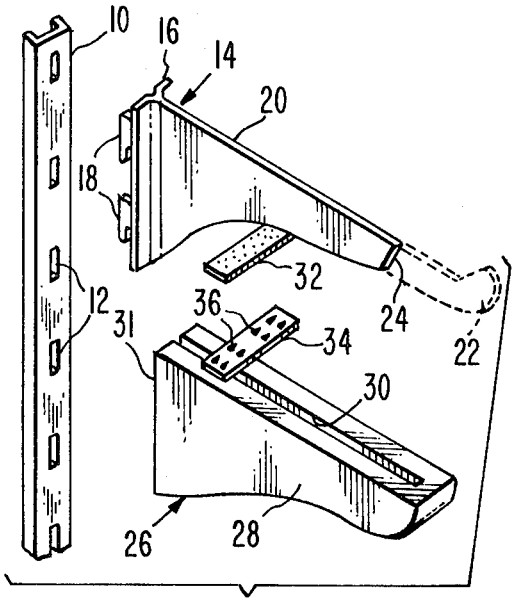
Fig. 1
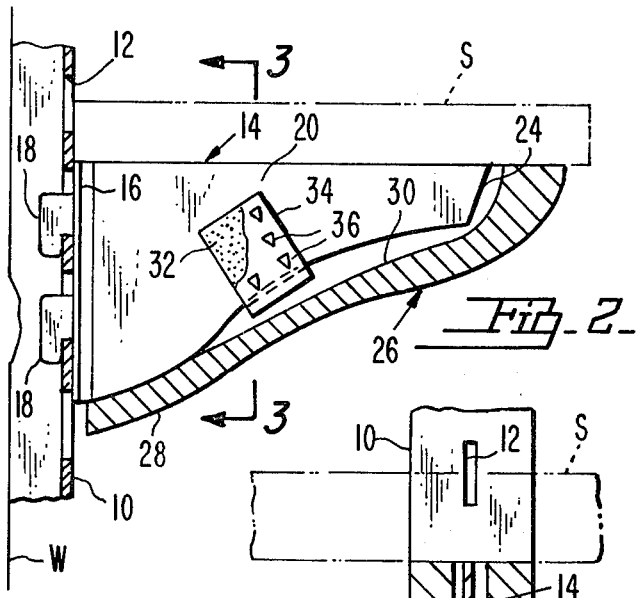
Fig. 2
Fig. 3
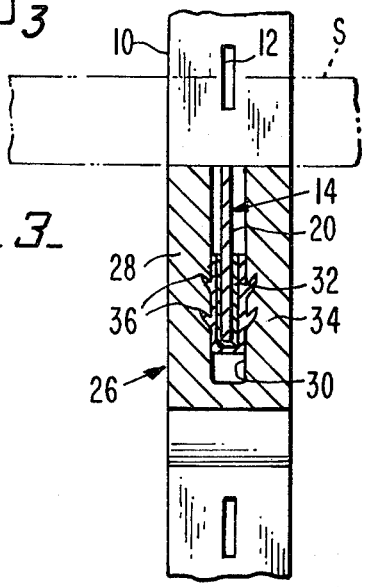
Fig. 6
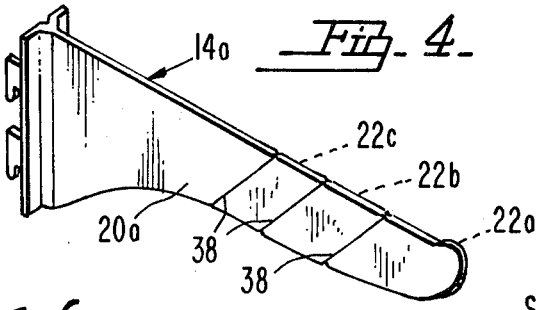
Fig. 4
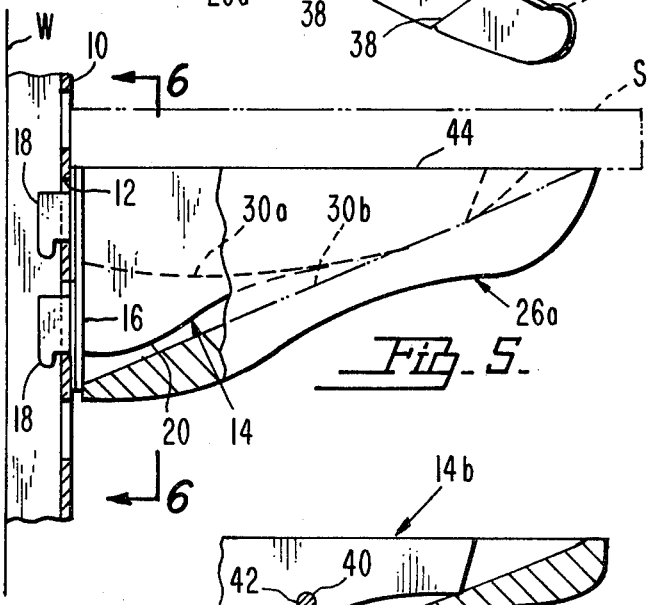
Fig. 5
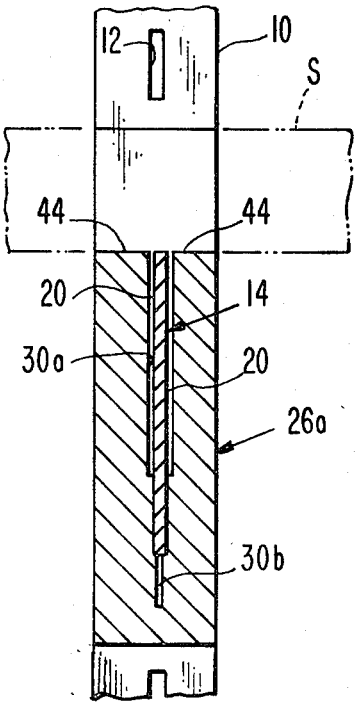
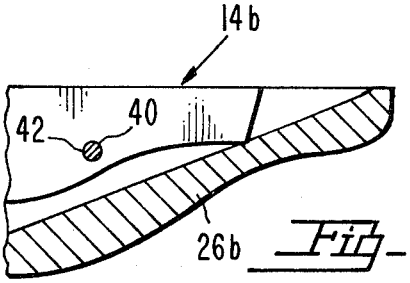
Fig. 7

COVER SLEEVE FOR SHELVING BRACKETS OF THE BLADE TYPE

BACKGROUND OF THE INVENTION

1. Field of Invention

The present invention relates generally to shelving systems, and in a more particular sense relates to those systems in which sheet metal, blade-like brackets are connectable to standards at selected locations, as for example by engagement of hooks of the brackets in slots of the standards. The invention has reference, in shelving systems of this type, to a sleeve-like covering applicable to a bracket of the type described, the covering when so applied having a cosmetic function in that it conceals the bracket without detracting from the functionality thereof.

2. Description of the Prior Art

A very popular type of shelving system includes channels having a longitudinal series of slots, so that when the channels are mounted on a wall surface they may receive outwardly projecting, blade-like brackets. The brackets are equipped with hooks, to permit them to be engaged in selected slots of the standards. In this way, the brackets are adapted to support shelves at selected locations and at selected distances from one another.

Brackets of the type described are conventionally formed from sheet metal material, with nose portions that project beyond the front edges of the shelves to keep them from sliding off the brackets. Brackets of this type, while wholly efficient for their intended use, are designed primarily for ease of installation by the ordinary householder. In accomplishing ease of installation, however, they detract from the attractiveness of the overall shelving system.

Attempts have been made in the prior art to enhance the appearance of quickly-erectible, knock-down shelving systems of the general type described above. It has been proposed, for example, to embed hooks or support plates within wooden shelf brackets. These facilitate the attachment of the brackets to a standard. Basically, however, this has been accomplished only by discarding the shelf brackets now in use, and substituting completely new bracket cores or equivalent shelf mounts.

The prior art thus has not solved the problem of utilization of basically conventional shelf brackets, in a manner to completely conceal the unattractive blade-like arms thereof without loss of the bracket function. The basic purpose of the present invention is to eliminate this deficiency noted in the prior art devices.

SUMMARY OF THE INVENTION

Summarized briefly, the invention is a cover sleeve of block-like form, which can be ornamentally shaped in any manner desired. Typically, the sleeve would be made from wood. This is so because shelving typically is made of wooden material. It becomes desirable, thus, to match the brackets with the shelving, giving the brackets the appearance of fine cabinet work. Alternatively, it may be equally desirable that the brackets be fashioned to harmoniously blend with or for that matter to contrast with the supported shelves. And, it is desirable, too, to permit the bracket-enclosing sleeves to be fashioned in contemporary, colonial, or other decors according to the taste of the particular purchaser.

The cover sleeve comprising the present invention is adapted to be mass-produced in any of a wide variety of shapes, sizes, and materials that will accomplish the desirable aims set forth above. In every instance the bracket, regardless of its exterior configuration, has an upwardly opening groove which receives the metallic, blade-like bracket arm conventionally offered commercially. When the bracket arm is inserted, it is engaged tightly in the sleeve, although the shelf-engaging top edge of the bracket remains flush with the top surface of the cosmetic, sleeve-like covering. The function of the bracket thus is retained, that is, the blade-like arm continues to be the support for the shelf, although seemingly the cover sleeve, at least to the casual viewer, appears to be discharging the support function.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIG. 1 is an exploded perspective view of a portion of a shelving system, and of one of the cosmetic cover sleeves as it appears immediately prior to application to the bracket arm, the dotted lines indicating a portion of the bracket that may be removed preliminary to assembly with the sleeve;

FIG. 2 is a vertical section through the bracket and standard, a supported shelf being illustrated in chain-dotted outline, the several components being illustrated as they appear after final assembly and mounting on the standard;

FIG. 3 is a transverse sectional view substantially on line 3—3 of FIG. 2;

FIG. 4 is a perspective view of a modified form of shelving bracket especially well adapted for use with the cover sleeve comprising the present invention;

FIG. 5 is a view like FIG. 2, a portion of the cover sleeve remaining in elevation, showing a modified form of cover sleeve;

FIG. 6 is a view of the modified form of FIG. 5, taken substantially on line 6—6 of FIG. 5; and FIG. 7 is a fragmentary longitudinal sectional view of another modification.

DETAILED DESCRIPTION OF THE PREFERRED EMBODIMENTS

A conventional standard 10 of a shelving system is in the form of a shallow metal channel having a longitudinal series of mounting slots 12, and adapted to be fixedly secured in a vertical position to a wall surface W.

The shelving system includes, also, shelf support brackets only one of which has been illustrated, generally designated 14. The shelf bracket 14 includes a base 16 having rearwardly projecting mounting hooks 18 insertable in selected ones of the slots 12. Hooks 18, when inserted, are thereafter forced downwardly within the slots. In this way, they are caused to lock in the slots. The bracket is thus securely mounted at a selected elevation of supporting a shelf S.

Bracket 14 includes a forwardly projecting, blade-like arm 20 rigid with bracket base 16. Typically, arm 20 is formed with an upwardly projecting nose portion 22. This extends beyond the front edge of the supported shelf S. It thus confines the shelf between the extremity of the bracket arm and standard 10. This prevents the shelf from sliding forwardly off the bracket. It may be noted at this point that the danger of a shelf being jarred off its underlying support brackets is not in any event great. It is not uncommon, accordingly, for a householder to saw off the end of a shelf bracket so that it will terminate short of the front edge of the shelf. This is done for the purpose of improving the overall appearance of the shelving system by eliminating the prominently located nose portions 22.

In accordance with the present invention, the nose portion 22 of the bracket is cut off, as for example along the line 24. This permits it to be embedded within and wholly enclosed by the cover sleeve 26 comprising the present invention.

In the form of the invention illustrated in FIGS. 1–3, sleeve 26 is formed from a single block 28 of wood material. At this point, it may be noted that it could be molded of plastic material to a selected ornamental shape without detracting from the effectiveness of the invention.

Block 28 is formed with a deep kerf or groove 30 opening upon the inner or base end of the block, shown as the left hand end in FIGS. 1 and 2, and terminating a short distance inwardly from the other extremity of the block. The block is of any desired ornamental shape, and thus could be of contemporary or in any of various period designs, to harmonize with the decor of the room in which the shelving system would be mounted.

When viewed in longitudinal section as in FIG. 2, the block 28 reveals the slot 30 to be of a shape that will accommodate the entire blade portion of the bracket. Thus, in the illustrated example, the slot 30 is progressively of greater depth in a direction from the closed end of the slot located near the distal extremity of the sleeve, fully to the base or proximal end of the sleeve. There, the slot opens over its entire depth upon the base end 31 of the sleeve.

In FIG. 3, the width of the slot has been exaggerated solely for the purpose of illustrating the mechanical features of the invention. It is there seen (reference should also be had to FIGS. 1 and 2) that in accordance with the invention, means is provided for causing the bracket arm to be tightly gripped by the cosmetic sleeve, when the bracket has been fully inserted in the manner shown in FIG. 2. To this end, I provide in the form of the invention shown in FIGS. 1–3, a short length of double sided adhesive tape 32. This is positioned against the underside of the bracket arm, and folded upwardly along opposite faces of the bracket arm to adhere tightly thereto in the position shown in FIG. 2. Then, a length of thin metal corresponding in shape and size to the tape 32 and designated at 34, is similarly positioned against the underside of the tape and folded upwardly so as to be adhesively engaged against the outer face of the tape at both sides of the bracket arm. The metal used would be readily bendable under finger pressure, so as to assume the final, folded shape shown in FIGS. 2 and 3.

The metal element 34 is provided with lanced-out gripping teeth 36. These are angled downwardly as in FIG. 3 when the metal is applied to the adhesive tape, and as a result insertion of the bracket arm into the slot 30 to its full extent will cause the bracket to be tightly engaged in the groove. This results from the extension of the teeth 36 into the softer material of the wood, in such a way as to prevent the sleeve from being pulled downwardly off the bracket. When the bracket is fully inserted, the top edge thereof is flush with the top surface of the sleeve, as shown in FIG. 2. As a result, the metal bracket continues to be the support for the weight of the shelf S, although fully concealed by the cover sleeve 26. In these circumstances, the cover sleeve is seemingly the sole support for the shelf.

In FIG. 4, there is illustrated a metal bracket 14*a*, having the nose portion 22*a*. The bracket is wholly conventional, in respect to outer configuration and length, and differs from those presently in commercial use only in that it includes a plurality of inclined score marks or weakened lines 38, spaced longitudinally of the blade-like arm 20*a* of the bracket.

The provision of the weakened lines 38 defines removable portions 22*a*, 22*b*, 22*c*, one or more of which can be removed, according to the needs of the particular user. For example, portion 22*a* might be removed, leaving a bracket of intermediate length with the portions 22*b*, 22*c* left intact to fit into a cosmetic sleeve, not shown, which would be of a length just sufficient to accommodate the bracket after portion 22*a* has been removed. Or, one might remove portion 22*b* as well. This would produce a somewhat shorter bracket, usable to advantage with a narrower shelf S. Yet another possibility is to remove, also, the portion 22*c*. This would leave a short bracket arm, receiving a cosmetic sleeve the groove of which would be, in length, just sufficient to receive the shortened bracket. This would be usable to advantage with shelves that are of a minimum width deemed sufficient for commercial usage.

In this way, a bracket such as shown in FIG. 4 could be manufactured so that if desired, it could be used without a cosmetic sleeve 26. In these circumstances, the bracket could be left at full length including the nose portion 22*a*. Or, the bracket could be made to a selected shorter length, so as to provide a universal bracket for shelves of different widths. Still further, it can be used in any of the various selected lengths provided for by the weakened lines 38, with a sleeve 26 the groove 30 of which would be sized to receive the adjustably shortened bracket.

In FIGS. 5 and 6, there is shown another form of the invention in which the sleeve has been designated 26*a*. In this form of the invention the blade-like arm 20 or 20*a* is gripped by the sleeve without requirement of using the adhesive and gripping elements 32, 34 respectively.

This is accomplished by a manufacturing process in which the bracket-receiving groove has an upper portion 30*a* which is of greater width than the thickness of the blade-like arm 20 or 20*a*. The bracket-receiving groove also, however, has a bottom portion 30*b* which is distinctly narrower than the upper portion 30*a*. *Portion 30b* would be of a width that is slightly less than the thickness of the blade, to an extent such as will cause the bottom edge portion of the blade 20 to enter the groove or slot portion 30*b* only in response to a positively applied force. The blade, when caused to enter the slot portion 30*b*, wedges tightly therein due to the fact that it is of slightly greater thickness than the slot portion 30*b*.

A simple method of manufacturing a sleeve of the type shown in FIGS. 5 and 6 is provided in accordance with the invention. Initially, one may form the slot portion 30*a* by means of a table saw, the circular blade of which is selected to form the upper portion 30*a* (see FIG. 5) as an arcuate slot. Thereafter, one may use a back saw making an angle cut from the toe to the heel of the workpiece as shown by the chain-dotted lines in FIG. 5. In that figure, the chain-dotted outline indicates the reach of the lower slot portion 30*b*, while the dash lines indicate the form of the wider slot ortion 30*a*. Basically, this provides for the wider and narrower slot portions, communicating with each other to receive the blade. The blade initially enters the wider slot portion with ease, and thereafter wedges tightly in the lower slot portion 30*b* when the blade arm is fully recessed within the sleeve as in FIGS. 5 and 6.

The sleeve, as previously noted, can be of any desired ornamental shape, so long as it retains the structural and functional characteristics described above. It could, thus, be exteriorly shaped to harmonize with room decor of any desired furniture period. And, it can be stained, painted, or otherwise exteriorly finished as desired.

The device can further be adapted to any existing brackets. This permits the brackets to be sold as at present, without covering sleeves. Or, one may purchase the brackets with covering sleeves of an appropriate size. The sleeves and the brackets would come in a selection of sizes, possibly in one-inch increments. The selection would be made according to the width of the shelves. No modification in the conventional brackets now available is necessary. However, one could if desired make the brackets as shown in FIG. 4. This would not only facilitate the application of an appropriate sleeve by removal of one or more of the portions 22*a*, 22*b*, 22*c*. The FIG. 4 arrangement has the added benefit that even without the use of the cover sleeves, the metal bracket can be made in fewer sizes than heretofore required.

Other methods of quickly and easily attaching the sleeves to the bracket can be used. For example, the bracket and sleeve may be formed with transverse opening registrable when the bracket is inserted, for insertion of a dowel, as shown in FIG. 7, in which bracket 14*b* has opening 40 registering with a corresponding transverse opening of the sleeve 26*b* to receive dowel or pin 42, the opposite ends of which would be flush with the opposite side surfaces of the sleeve to be painted over or stained along with the sleeve.

It may also be noted that means can be provided for causing the shelf S to be effectively gripped by the top surface of the bracket and sleeve even though the nose portion 22 or 22*a* has been removed. Thus, one may apply narrow, double-sided adhesive tapes 44, 44 (see FIGS. 5 and 6), to the top surface of the sleeve. This will cause the shelf S to be effectively retained against accidental sliding movement off the support bracket. The same means can be provided, of course, in the form of the invention shown in FIGS. 1—4 and 7.

It is also thought possible that if it is not desired to remove the nose portion of the metal bracket, the sleeve itself can be formed with a nose portion to receive that of the bracket. In this event, the slot would be continued further toward the distal end of the sleeve, to an extent sufficient to receive the nose portion 22.

The device, it will be seen, permits sale of the sleeve to individuals who have already installed brackets of the type illustrated. Or, the sleeve can be sold along with conventional brackets as shown. Still further, brackets can be modified so as to be specially shaped to receive the sleeve. All of these arrangements are believed to fall within the scope of the concept as previously described and illustrated herein.

While particular embodiments of this invention have been shown in the drawings and described above, it will be apparent, that many changes may be made in the form, arrangement, and positioning of the various elements of the combination. In consideration thereof it should be understood that preferred embodiments of this invention disclosed herein are intended to be illustrative only and not intended to limit the scope of the invention.

I claim:

1. A cover sleeve for application to a shelf bracket of the type having a blade-like shelf support arm, comprising:

(a) a block having a slot for receiving said arm; and (b) means for engaging the arm against removal from the slot, said means being in the form of a shim foldable about the bracket arm within the slot, said shim including a length of foldable metal material having teeth adapted to engage in opposite sidewalls of the slot, the shim further including a double-sided adhesive tape foldable about the bracket arm for engagement therewith, and adapted to receive the folded length of metal material for connecting the same to the bracket arm.

2. A shelf bracket comprising, in combination with a blade-like shelf support arm:

(a) a block having a slot for receiving said arm; and (b) means for engaging the arm against removal from the slot, said means being in the form of a shim foldable about and embracing the bracket arm within the slot, said shim including a length of foldable metal having teeth adapted to engage in opposite sidewalls of the slot and further including a double-sided adhesive tape foldable about the bracket arm, said tape being interposed between the arm and the folded length of metal in face-to-face, adhesive engagement both with the arm and said length of metal, whereby to connect the folded length of metal to the bracket arm, said arm having weakened areas spaced along its length to permit removal of selected portions of the length of the arm, whereby to adjust the arm length to a selected shelf width to be supported.

3. A cover sleeve for application to a shelf bracket of the type having a blade-like shelf support arm, comprising:

(a) an elongated block having a bottom and one end that are closed, the block having a deep narrow slot that extends longitudinally and centrally thereof and opens over its entire length upon the top surface of the block and upon the other end thereof, the slot being of a length and depth greater than the length and depth of the arm, whereby the block may be positioned upon the arm by shifting the block upwardly to an extent sufficiently to locate the arm wholly within the slot with the top surfaces of the block and arm flush with each other; and (b) means wholly concealed within the block adapted, responsive to shifting the block upwardly to receive the arm, for creating a gripping action between the slot walls and the arm whereby to secure the block to the arm, said means comprising a length of tape foldable about and embracing the arm, said tape having adhesive on opposite faces thereof whereby one face adheres to the arm, and a gripping element foldable about and embracing the tape with the other face of the tape adhering to one face of said element, the other face of said element having teeth engaging the walls of the slot responsive to the shifting of the block upwardly to a position in which the arm is disposed wholly in the slot and the top surfaces of the arm and block are in a flush relationship.

* * * * *

UNITED STATES PATENT AND TRADEMARK OFFICE

CERTIFICATE OF CORRECTION

PATENT NO. : 4,431,155

DATED : February 14, 1984

INVENTOR(S) : Bob Engel

It is certified that error appears in the above-identified patent and that said Letters Patent is hereby corrected as shown below:

Column 5, line 2, "ortion" should read -- portion --.

Column 5, line 33, "opening" should read -- openings --.

Column 5, line 49, "Figs. 1-4 and 7" should read -- Figs. 1-3 and 7 --.

Signed and Sealed this

Twenty-second Day of May 1984

[SEAL]

Attest:

GERALD J. MOSSINGHOFF

Attesting Officer

Commissioner of Patents and Trademarks